US010532259B2

(12) United States Patent
Logan

(10) Patent No.: US 10,532,259 B2
(45) Date of Patent: Jan. 14, 2020

(54) GOLF CLUB CARRIER

(71) Applicant: Andrew Logan, Torbay (NZ)

(72) Inventor: Andrew Logan, Torbay (NZ)

( * ) Notice: Subject to any disclaimer, the term of this patent is extended or adjusted under 35 U.S.C. 154(b) by 46 days.

(21) Appl. No.: 15/802,484

(22) Filed: Nov. 3, 2017

(65) Prior Publication Data

US 2018/0280772 A1 Oct. 4, 2018

(30) Foreign Application Priority Data

Mar. 31, 2017 (NZ) ..... NZ730703

(51) Int. Cl.
*A63B 55/30* (2015.01)
*A63B 55/40* (2015.01)
*A63B 55/10* (2006.01)

(52) U.S. Cl.
CPC ..... *A63B 55/30* (2015.10); *A63B 55/10* (2013.01); *A63B 55/40* (2015.10)

(58) Field of Classification Search
CPC ..... A63B 55/10; A63B 55/30; A63B 55/40; A63B 55/60; B62B 1/262; B62B 3/102; B62B 2202/404; B62B 2202/406
USPC ..... 280/DIG. 5, DIG. 6
See application file for complete search history.

(56) References Cited

U.S. PATENT DOCUMENTS 1,951,492 A * 3/1934 Schneider ..... A63B 55/10 206/315.2
4,062,564 A * 12/1977 Schimmeyer ..... B62B 5/085 280/652
4,078,594 A * 3/1978 Oeckl ..... A63B 55/00 206/315.4
4,753,446 A * 6/1988 Mills ..... A63B 55/00 206/315.6
5,454,576 A * 10/1995 Pitkanen ..... A63B 55/60 280/42
5,907,543 A * 5/1999 Jeon ..... H04W 48/20 370/335
6,186,520 B1 * 2/2001 Barten ..... B62B 1/042 280/30
6,997,274 B2 * 2/2006 Metten ..... A63B 55/00 180/19.1
2004/0011929 A1 * 1/2004 Haugen ..... A63B 55/60 248/96

FOREIGN PATENT DOCUMENTS

GB 1480978 7/1977

* cited by examiner

*Primary Examiner* — Frank B Vanaman
(74) *Attorney, Agent, or Firm* — Joseph G. Chu; JCIP

(57) ABSTRACT

A golf club carrier comprising a body separated into two compartments, a first compartment to receive the shaft, handle first, of a golf club in a first direction and a second compartment to receive at least two spoked wheels used for transporting the golf club carrier over ground in a coaxial manner and parallel to and in a second direction opposed to the first direction to be stored at the second compartment, the interface between the first compartment and second compartment being shaped and adapted to allow the handle of the golf club to extend into each wheel between spokes of each wheel yet remain separated from the wheels by the interface.

9 Claims, 12 Drawing Sheets

GOLF CLUB CARRIER

RELATED APPLICATION

This application claims priority to, and claims the benefits of, the New Zealand Patent Application No. NZ730703 filed on Mar. 31, 2017, the content of which is incorporated by reference in its entirety herein.

BACKGROUND OF THE INVENTION

The present invention relates to golf club carriers such as golf bags and in particular to golf club carriers for storing detachable wheels.

Golf is a popular sport enjoyed by people of all ages around the world. Golf club carriers or bags are commonly used by golfers to carry and transport their golf equipment and supplies. The portability of golf bags may be desired as golfers often walk great distances across golf courses.

Golf bags with wheels may be beneficial for transporting generally heavy golf equipment, and supplies around golf courses with relative ease. Golf bags without wheels may allow a player to transport their golf bag with more ease around a golf course, where a trundler is not as applicable. Golf bags which are easily transportable may allow golfers to minimise strain and other injuries and to improve their golfing experience.

Golf bags with detachable wheels may be useful further as wheels may easily be detached for replacement, golf bags will be able to fit better within car trunks, and grass and dirt collected during the course of a game may be cleaned off with ease when the wheels are detached. Traditionally trundlers may be used to carry golf bags, trundlers can be removed from the bag for transporting the golf bag in a car.

Once the wheels of a trundler are detached, a problem golfers may face is finding a suitable and convenient place for storage of the detached wheels, especially when on a golf course.

It is an object of the present invention to provide a golf club carrier which overcomes or at least partially ameliorates some of the abovementioned disadvantages or which at least provides the public with a useful choice.

SUMMARY OF INVENTION

In a first aspect the present invention may be said to be a golf club carrier comprising,

- a body with (i) an upper region with at least one entry to receive a shaft of at least one golf club, club handle first, into a club compartment of the body, and (ii) a bottom region comprising a base opposite the at least one entry,
- at least two wheels, each wheel having a rotational axis and each wheel having one or more through openings, each wheel being moveable between;
  - a transporting condition where the wheels are externally dependent from, and configured to rotate and roll over ground and bear at least some of the weight of, the body, and
  - a stored condition where the wheels are detached from the body in the transporting condition, and stored coaxially to each other and within the body in a wheel compartment located at the bottom region of the body, the wheel compartment having an entry located at the base configured to receive the wheels when detached,

- a separator separating the club compartment from the wheel compartment, the separator being of a shape that complements the shape of at least some of the wheel openings of each wheel to allow the separator to project into the one or more through openings of the wheels when the wheels are stored in the wheel compartment, to accommodate the at least one golf club in a manner so that the club handle of the golf club can locate in one of the through holes of at least one wheel In one embodiment, the separator is configured to allow the club handle of the golf dub to locate at the wheel openings of each wheel without said at least one golf club coming into contact with said wheels.

In one embodiment, the golf club carrier comprises a wheel attachment device engaged to the body to which the wheels are attached when in their transporting condition, where the wheel attachment device is at least one leg and wherein two axles are presented by the at least one leg to each removably receive a said wheel and present said wheels in their transporting condition.

In one embodiment, the wheels, when in the transporting condition, are directly dependent or and indirectly dependent from the body.

In one embodiment, each wheel has multiple through openings each located between the rotational axis and the wheel perimeter.

In one embodiment, the wheels have identical shaped through openings.

In a second aspect the present invention may be said to be a golf club carrier able to be transported over ground utilising at least two wheels each having a hub defining a rotational wheel axis and a rim and webs or spokes extending between the hub and rim defining lateral openings through the wheel, the golf club carrier comprising:

- a body with (a) an upper region having at least one entry to receive a plurality of golf clubs into a club compartment of the body and (b) a bottom region comprising a base opposite the at least one entry at where a wheel compartment of the body is located, the wheel compartment having an opening at the base configured to receive the wheels, the wheel compartment configured to store the wheels in a coaxial and contiguous manner with each other and wherein a separator is provided, configured to separate the club compartment from the wheel compartment, the separator having a shape to receive the wheels in the wheel axis direction with pockets of the separator protruding through at least some of the lateral openings of the wheels so that a handle of at least one of the golf clubs is able to locate in a said pocket and in a lateral opening of each wheel.

In a further aspect the present invention may be said to be a golf club carrier adapted to be transported over ground utilising at least two wheels that each comprise of a hub defining a rotational axis for the wheel and a rim and at least one spoke connecting the hub with the rim so as to define at least one through opening of the wheel, the carrier comprising an elongate body to receive, via an upper opening of a club compartment of the elongate body, a plurality of golf dubs to be retained by the dub compartment, the club compartment having a bottom region opposite the upper opening with a separator that separates the club compartment from a wheel storage region at where the at least two wheels can be stored adjacent each other with their rotational axes parallel to the elongate direction of the body, the separator shaped to define at least one pocket of the club compartment that is able to extend through the at least one through opening of at least one wheel when the wheels are stored at the wheel storage region so that the handle of a golf club retained at the club compartment can locate in the pocket and extend into the through opening of at least one wheel.

In one embodiment, the separator complements the shape of the wheel openings so as to allow the separator to project into the one or more openings of the wheels in the stored condition.

In one embodiment, the club compartment extends through at least one opening of all of the stored wheels.

In one embodiment, the golf club carrier comprises a wheel attachment device.

In one embodiment, the wheel attachment device is a leg, pair of legs, stand or similar.

In one embodiment, the at least one entry is configured to receive at least a part of the leg, pair of legs, stand or similar.

In one embodiment, each wheel has multiple through openings through their opposite faces.

In one embodiment, there are three wheels.

In one embodiment, the wheels have identical through openings.

In one embodiment, the separator is an intermediate layer formed part of the at least part of the body.

In one embodiment, the intermediate layer has one or more pockets having a complementary shape to the one or more openings of a wheel.

In one embodiment, the intermediate layer is rigid.

In one embodiment, the intermediate layer forms pockets open towards the upper region, into which at least the end of at least one golf club can enter into.

In one embodiment, the pockets run the entire length of the body from the lower region to the upper region.

In one embodiment, the pockets are the depth of the width of one wheel.

In one embodiment, the pockets are the depth of the width of two wheels.

In one embodiment, the pockets are the depth of the width of three wheels In one embodiment, the pockets are the depth of the width of four wheels.

In one embodiment, the wheel compartment comprises a spring biased magazine.

In one embodiment, the magazine is biased towards the lowermost region of the wheel compartment.

In one embodiment, the body is elongate.

In one embodiment, the wheels enter into the wheel compartment with their rotational axis collinear with the elongate axis of the body.

In one embodiment, the shape of body in plan view is substantially circular.

In one embodiment, the diameter of a wheel is smaller than the diameter of the body.

In an alternative embodiment, the diameter of at least one wheel is larger than the diameter of the body, where the wheel(s) are stored external of the bag.

In one embodiment, the wheel compartment has no external sides to envelop the wheels.

In one embodiment, each wheel has 3 openings to form a 3 spoke wheel.

In one embodiment, the club carrier comprises a cover to cover the entry of the wheel compartment.

In one embodiment, the cover is a fabric cover.

In one embodiment, the cover is a rigid cover hinged with the body.

In an alternative embodiment, the wheel compartment is the length of the golf club carrier.

In one embodiment, there is a stopper to prevent the wheels from travelling up the length of the wheel compartment.

In one embodiment, the club compartment or pockets extend to the base.

Also herein described is a golf dub carrier comprising an elongate body configured to receive and store golf clubs, the body having a receptacle located at its base configured to receive wheels in a lay flat condition with their rotational axes parallel or collinear with the elongate axis of the body, wherein the wheels are received into the receptacle at an end of the body opposite to where the body receives said clubs.

In one embodiment, the wheels are able to be removed from the receptacle and attached to, or dependent from, the body.

In one embodiment, the club carrier is compartmented, a storage chamber for golf clubs, and a receptacle for storing wheels.

In one embodiment, the wheels have multiple through openings through their ends.

In one embodiment, the storage chamber is configured to extend into the openings of the wheels when the wheels are stored in the receptacle.

In one embodiment, the club carrier comprises a lid to open and close the receptacle.

In one embodiment, the base of the storage chamber comprises shell like protrusions that complement the shape of the openings of the wheels, where the shell like protrusions are configured to extend into the openings of the wheels, when the wheels are stored in the receptacle.

In one embodiment, the protrusions extend to the lid.

In a further aspect the present invention may be said to be a golf dub carrier comprising a body separated into two compartments, a first compartment to receive the shaft, handle first, of a golf club in a first direction and a second compartment to receive at least two spoked wheels used for transporting the golf club carrier over ground in a coaxial manner and parallel to and in a second direction opposed to the first direction to be stored at the second compartment, the interface between the first compartment and second compartment being shaped and adapted to allow the handle of the golf dub to extend into each wheel between spokes of each wheel yet remain separated from the wheels by the interface.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

Preferred forms of the present invention will now be described with reference to the accompanying drawings in which.

DETAILED DESCRIPTION

Figure 1:
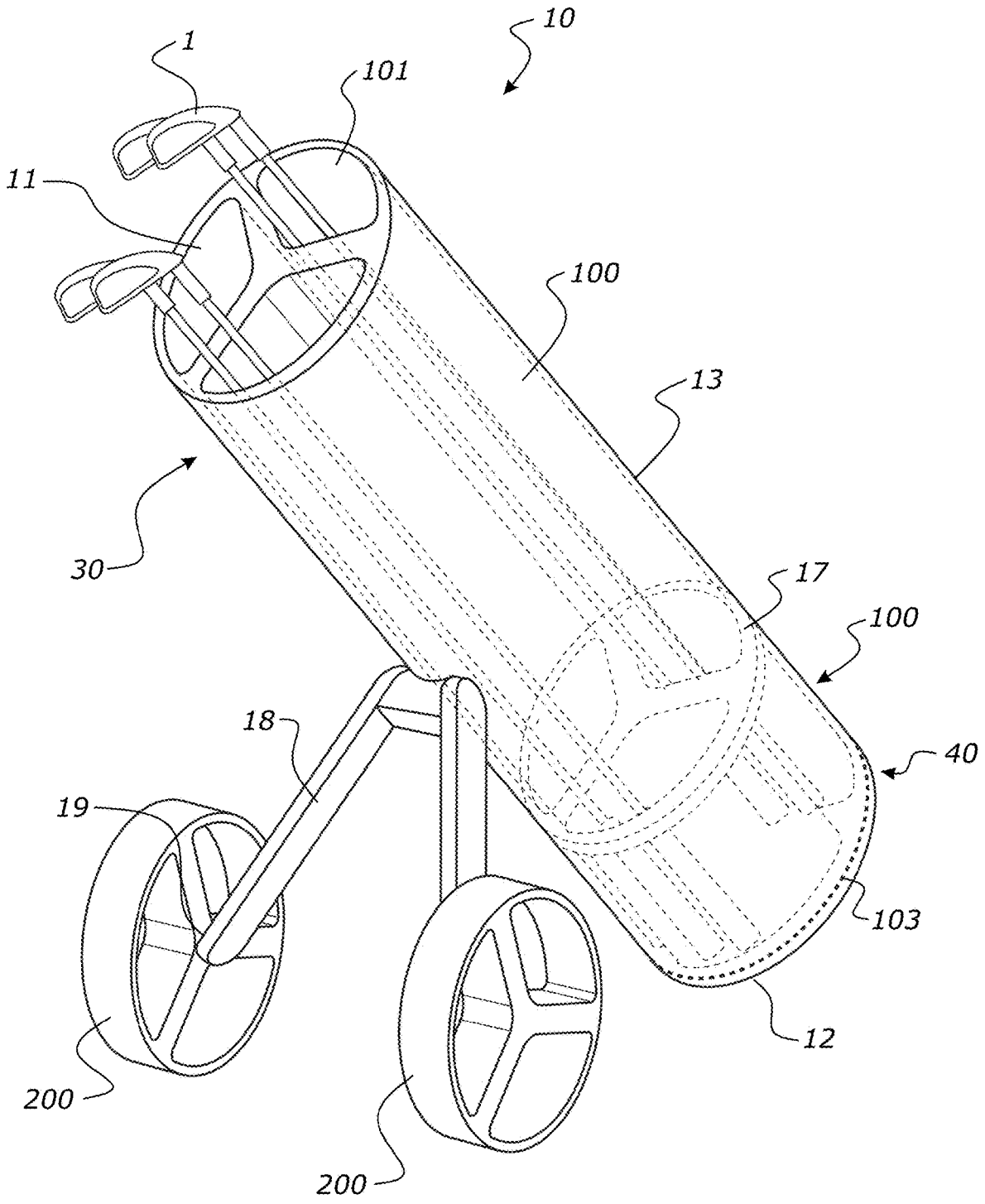
FIG. 1 shows a perspective view showing a golf club carrier with a wheel compartment or receptacle.

In FIG. 1 there is shown a golf club carrier 10 (in the form of or to form part of a golf bag 10) comprising a body 13. The body may have a golf dub compartment 101 and a wheel receptacle or wheel compartment 100. Preferably the wheel compartment 100 is located at least partially in the bottom region 40 of the bag 10 and preferably within or integral with the body 13 at its base.

The golf club compartment 101 is configured to receive and store at least one golf club 1. Typically the at least one golf club 1 is inserted into the golf club compartment 101 handle first but may be loaded club head first instead. The handle is where the user typically grips a golf club during use. The head of the golf club (that part which strikes the golf ball) is inserted onto the compartment last or is left external of the golf club compartment 101 when the club is stored in the bag. The golf clubs 1 are shown inserted handle first in all figures where a golf club is shown. Preferably golf clubs 1 are stored in the golf bag 10 using the entire length 21 of the carrier, including utilising the wheel compartment 100. This is achieved by having the club compartment 101 extend towards the base 12 of the golf bag 10. Some dotted lines of the golf club compartment 101 in some of the drawings are missing for clarity within the golf bag 10.

The wheel compartment 100 is preferably configured to receive and store one or more detachable wheels 200. The wheel compartment 100 preferably comprises a cavity 105. The detached wheels 200 when stored at the compartment will not need to be carried separately. This helps reduce the prospect that the wheels get misplaced or lost.

A golf club carrier 10 with a wheel compartment 100 within or integral with the body 13 is advantageous over a golf bag which has an external compartment configured to store detachable wheels. An external compartment is generally more bulky and less aesthetically pleasing and the wheels generally take up space where other golf equipment would usually reside. The wheel compartment 100 of the present invention allows the storage of the wheels 200 in a compact and unobtrusive manner yet does not compromise the effective club compartment length.

When not stored, the wheels 200 can be attached directly dependent or indirectly dependent from the body 13 of the body of the club carrier 10. The wheels when attached aid in transport of the golf bag. In the transporting condition, the wheels 200 are configured to rotate and bear at least some of the weight of the body 13.

The wheels 200 comprise a central hub that may be able to be connected to an axle or similar. Each wheel preferably has webs or spokes extending preferably radially from the hub to the rim of the wheel. There may be one web or spoke but preferably a plurality of webs or spokes. The webs or spokes together with the hub and rim define at least one opening through the wheel.

Figure 2:
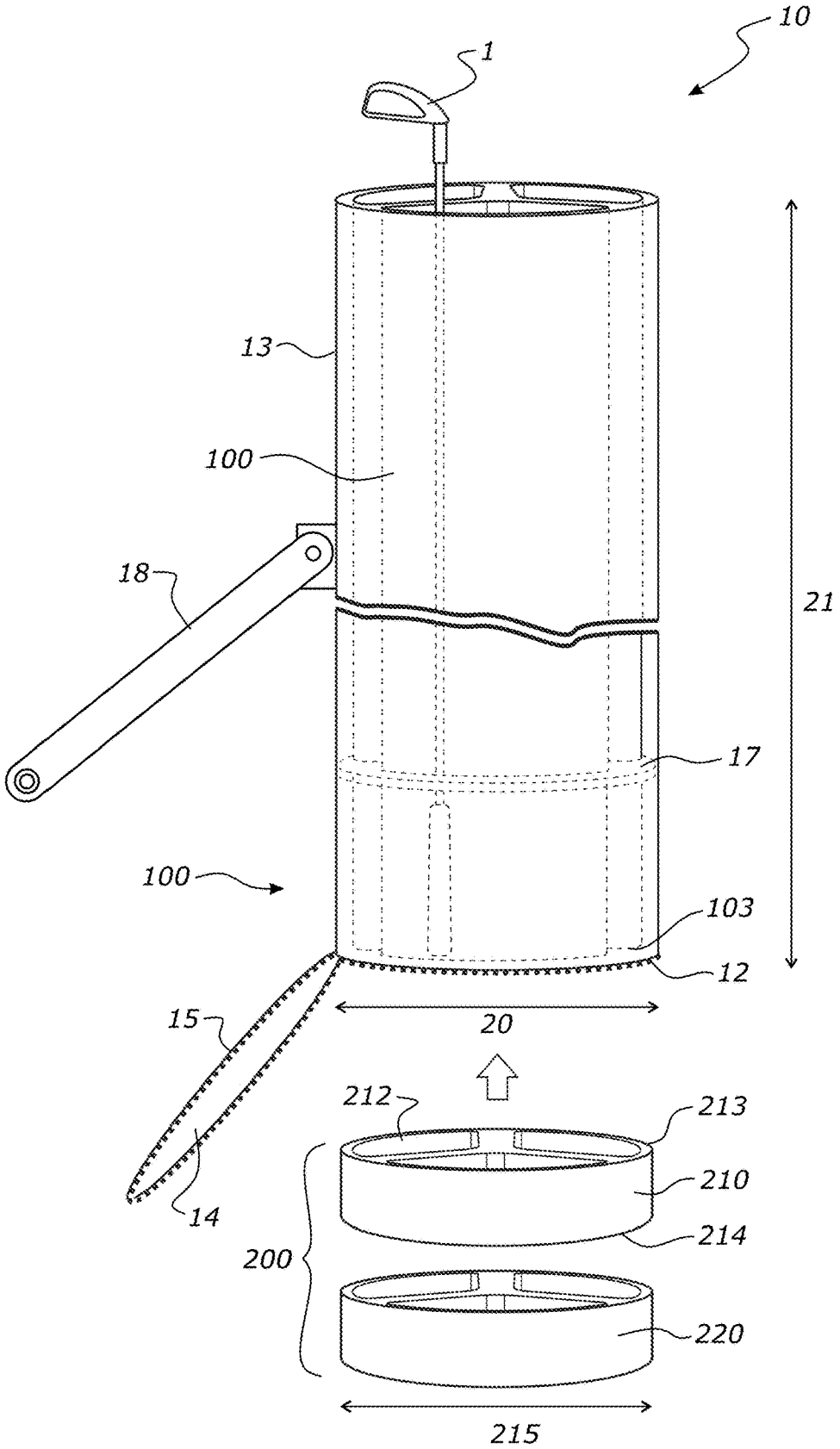
FIG. 2 shows a side view of a golf club carrier with detached wheels entering the wheel compartment.

FIG. 2 shows the wheels 200 entering the wheel compartment 100. In the preferred embodiment, one or more detached wheels 200 are inserted into the body 10 from the base 12 of the body 13, in a contiguous manner. By contiguous it is meant that the wheels may touch each other or may be close but not touching. The wheels are preferably stored with their rotational axes coaxial. Preferably, a user inserts detached wheels 200, or remove stowed wheels 200, without having to remove stowed golf dubs 1. Likewise golfers can remove or insert golf clubs 1 from or into the dub compartment without having to remove stowed wheels 200.

Figure 3:
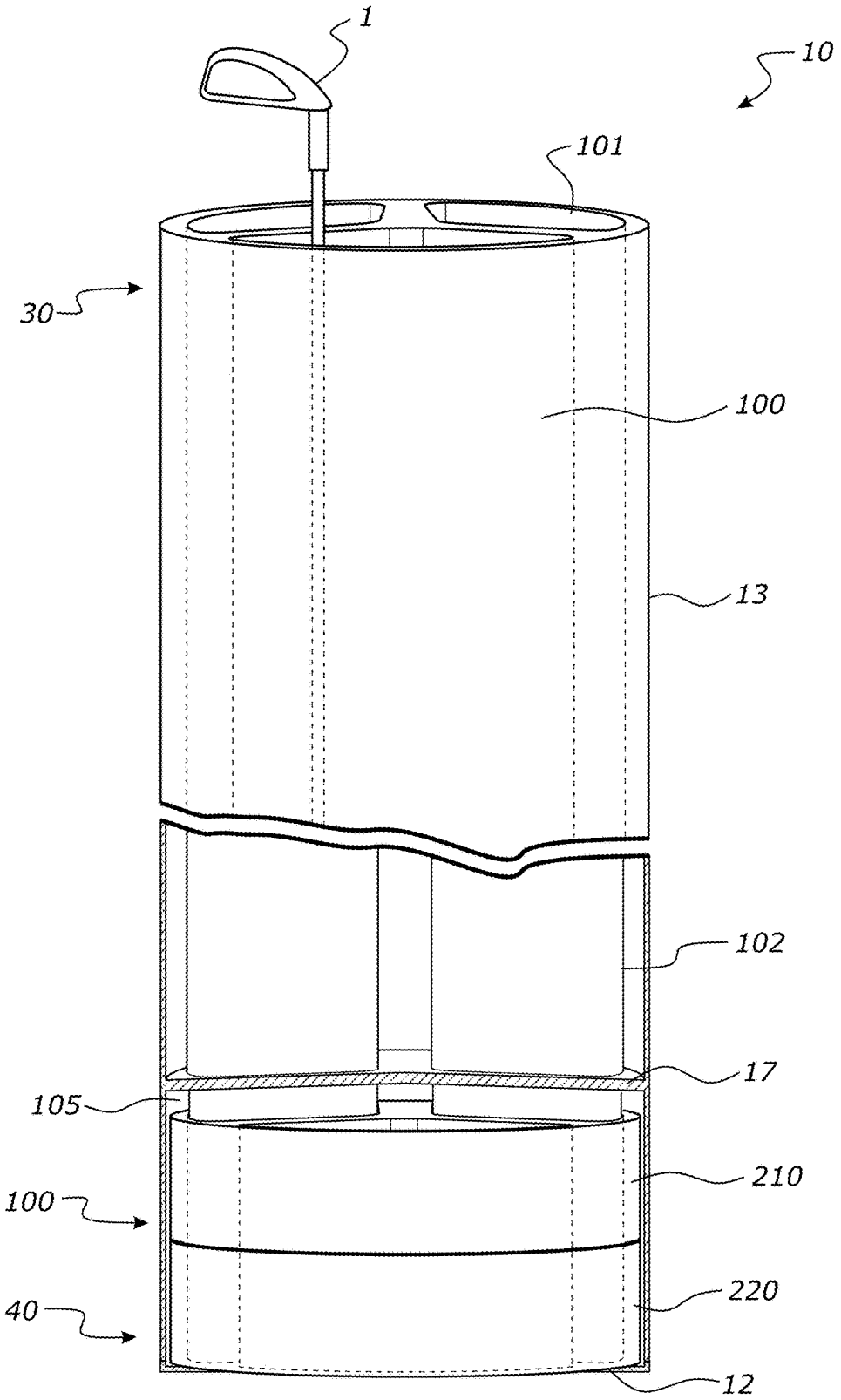
FIG. 3 shows a side view of a golf club carrier with stored wheels.

FIG. 3 shows a separator 102 configured to separate stowed golf dubs 1 from stowed wheels 200. An advantage of separating the golf clubs 1 and the wheels 200 from contact is to limit or prevent transfer of mud and grass etc. on the wheels 200 which may have been accumulated during gameplay to the golf clubs 1. A wheel compartment 100 to separate clubs 1 and wheels 200 also preferably limits or prevents movement of the stored clubs 1 and wheels 200 to reduce damage due to the items rubbing against each other or the body 13.

Figure 3A:
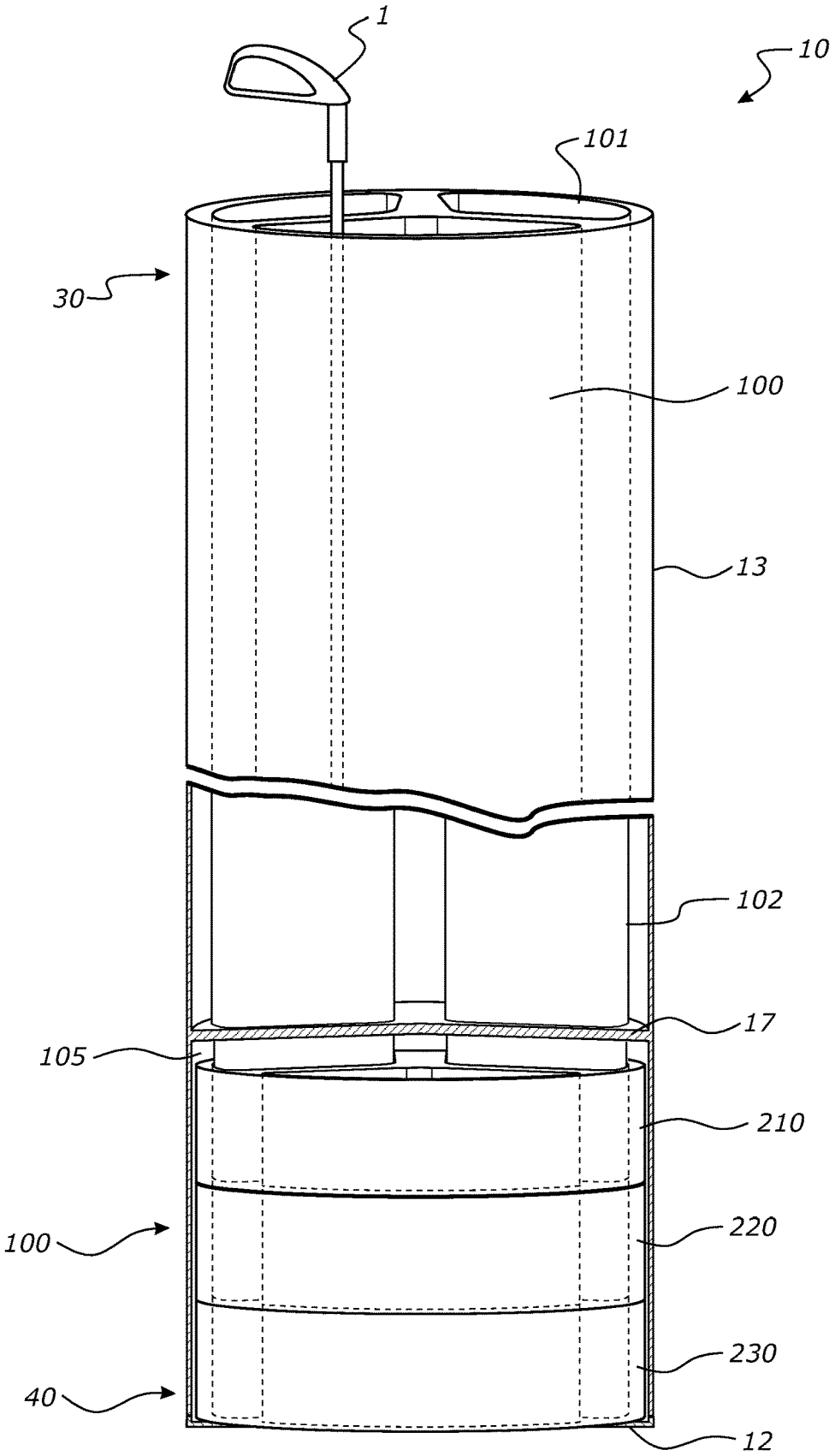
FIG. 3A shows a side view of a golf club carrier with three stored wheels.

FIG. 3A also shows a separator 102 configured to separate stowed golf dubs 1 from stowed wheels 210, 220, and 230. The wheel compartment 100 to separate dubs 1 and wheels 210, 220, and 230 also preferably limits or prevents movement of the stored dubs 1 and wheels 210, 220, and 230 to reduce damage due to the items rubbing against each other or the body 13.

The separator 102 may be an intermediate layer of the wheel 100, an independent stopper 17, or protrusions 104 of wheel compartment 100. The separator is preferably secured to the club compartment of the wheel compartment or both and may be integrally formed with one of both of the compartments.

In the preferred embodiment, the wheel compartment 100 and/or separator comprises protrusions or pockets 104 that extend into the openings 212 of the stored wheels to allow an end of the golf clubs 1 to enter through the wheel openings 212 without the golf clubs coming into contact with the wheels 200. In the preferred embodiment the separator 102 is an extruded or formed intermediate layer. Preferably the separator 102 is rigid.

In other embodiments, the wheel compartment 100 may be configured to store or also store other golf equipment such as clothing, golf balls etc. without hindering the length of usable space (length) for golf clubs 1 in the club compartment.

In the preferred embodiment the golf bag 10 comprises a body 13, a top opening 11 at an upper region 30, and a base 12 at a bottom region 40 opposite the upper region 30. The golf bag 10 may be made from plastics, polyethylene, woven material, non-woven material, fabric or leather etc. The golf bag 10 is preferably made from water resistant material as golf bags are designed to be used outdoors in all weathers.

In the preferred embodiment, the body 13 is elongate. The length 21 of the golf bag is preferably similar in length to the golf clubs 1. In the preferred embodiment, the golf bag 10 is substantially cylindrical in shape, where the shape of the body 13 in plan view is substantially circular. The golf bag diameter or width 20 is greater than the wheel diameter 215 of the wheels 200. In other embodiments, the golf bag is polygonal shaped in plan view. In the external wheel compartment 100 embodiment shown in FIG. 4D the wheels 200 may have a larger diameter (not shown) than the body.

Figure 5:
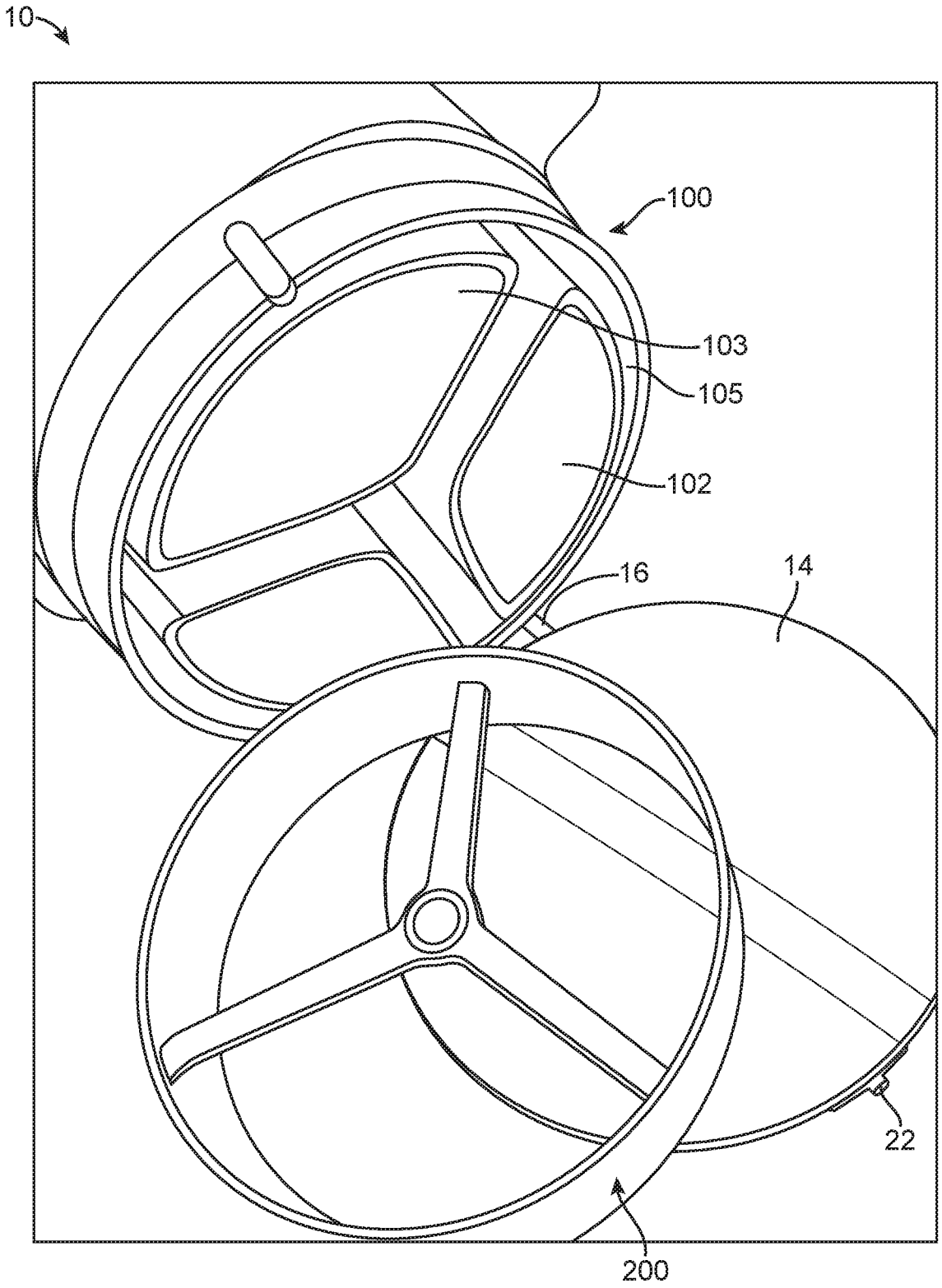
FIG. 5 shows the bottom region of the golf club carrier, including a wheel and the lid.
Figure 7A:
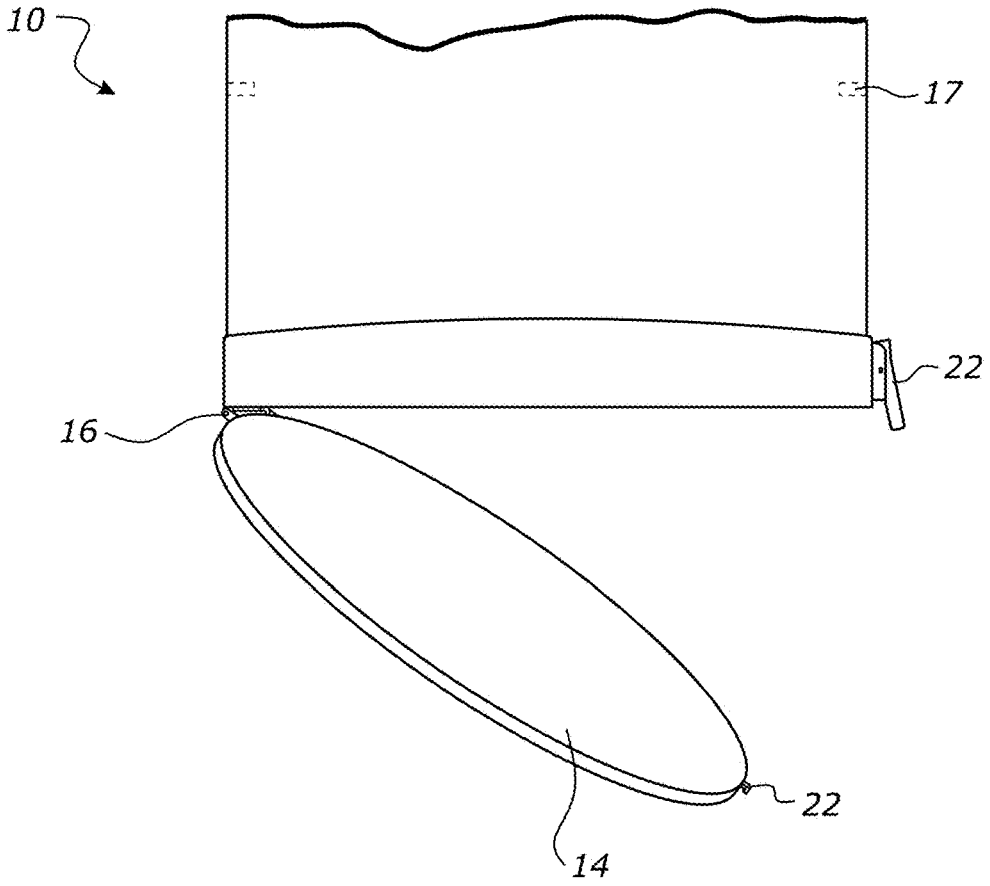
FIG. 7A shows a detail side view of a golf club carrier comprising a lid.
Figure 7B:
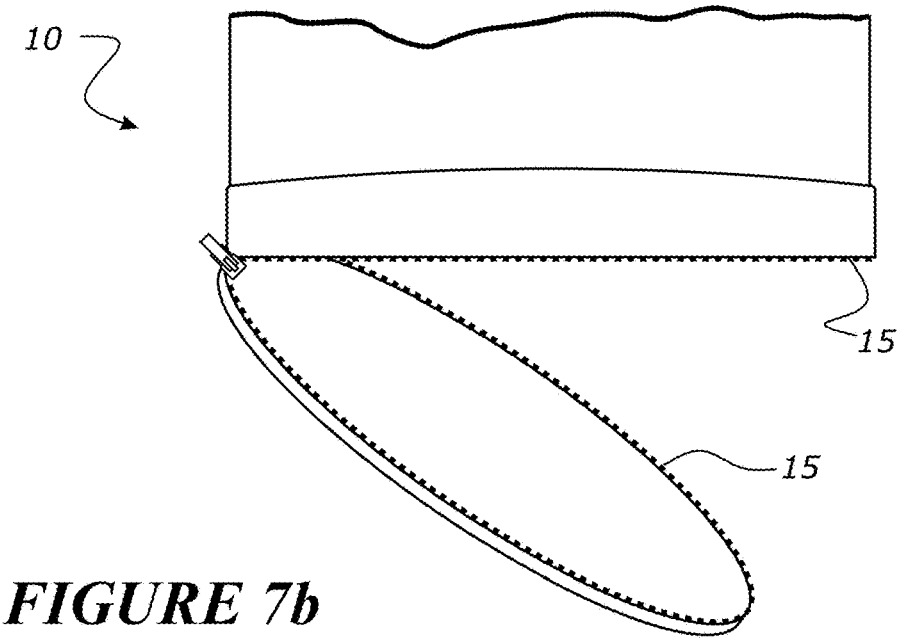
FIG. 7B shows a detail side view of a golf club carrier comprising a zipped cover.

The golf bag 10 comprises a lid or cover 14, which provides access at the base 12 of the bag 10 to the wheel compartment 100 and covers the base 12 of the bag. The lid or cover 14 in one embodiment is rigid as shown in FIGS. 5 and 7A. In other embodiments, the lid or cover 14 is a fabric cover as shown in FIGS. 2 and 7B.

In one embodiment, as shown in FIG. 7A, the lid or cover 14 is connected to the body 13 by a hinge 16. The lid or cover 14 is temporarily secured onto the base 12 of the bag 10 by a locking mechanism 22. The lid or cover 14 may be secured on to the base 12 by a snap fit mechanism, screwed on, or with a latch 22 etc. In one embodiment, as shown in FIGS. 1 and 7B, the lid or cover 14 comprises a zip 15 for joining the edge of the lid or cover 14 with the edge of the base 12 of the bag.

Figure 8A:
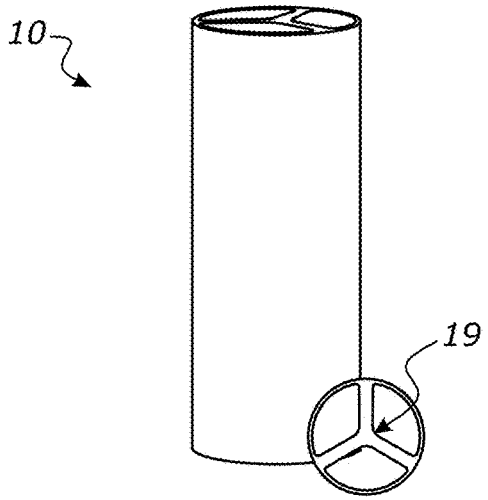
FIG. 8A shows a side view of a golf club carrier comprising wheels attached to an axle dependent from the body of the golf club carrier.
Figure 8B:
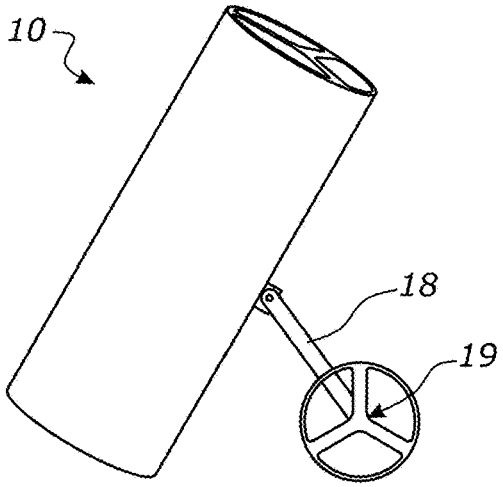
FIG. 8B shows a side view of a golf club carrier comprising wheels dependent from a trundler or stand.

The golf bag 10 may comprise a wheel attachment point 19 dependent from the body 13. The wheel attachment point 19 may be integral with the golf bag 10 as shown in FIG. 8A or further dependent on a wheel attachment device 18 as shown in FIGS. 1 and 8B. The wheel attachment device 18, such as an axle, may be dependent from a stand or trundler etc. In one embodiment, the wheel attachment device 18 is hinged with the body 13.

In one embodiment, the wheel attachment device 18 is attached externally to the body 13 of the bag 10. In another embodiment, the wheel attachment device 18 extends into the body 13 of the bag 10 to provide a stronger connection between the wheel attachment device 18 and the body 13 without hindering the length of usable space for golf clubs 1.

In one embodiment, the wheel attachment device 18, can be detached for storage within the golf bag 10. The wheel compartment 100 can be configured to store at least a part of the wheel attachment device 18 without hindering the length of usable space for golf clubs 1 in the club compartment.

Figure 8C:
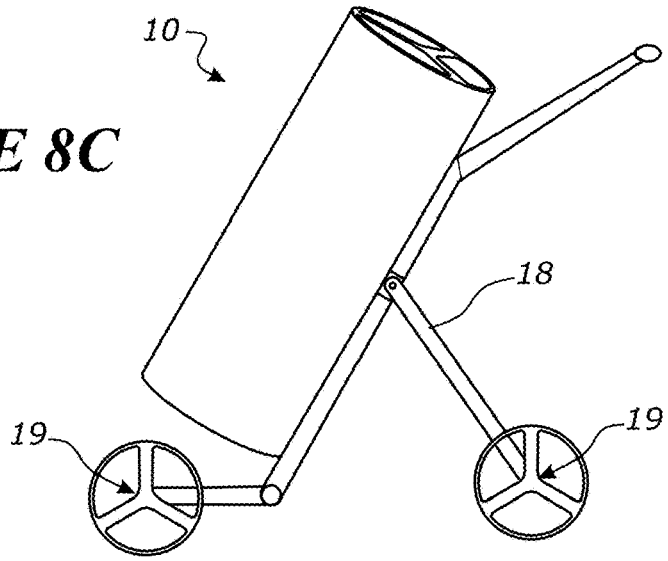
FIG. 8C shows a side view of a golf club carrier comprising 3 wheels dependent from a trundler or stand.
Figure 9A:
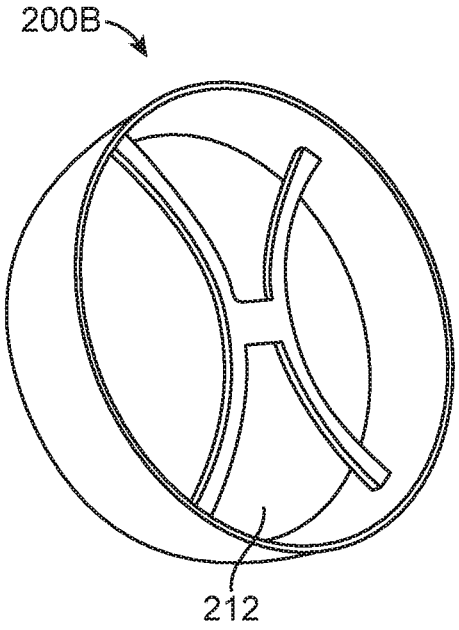
FIG. 9A, 9B, 9C, 9D show perspective views of different shaped wheels that will correspond with complementary wheel compartments.
Figure 9B:
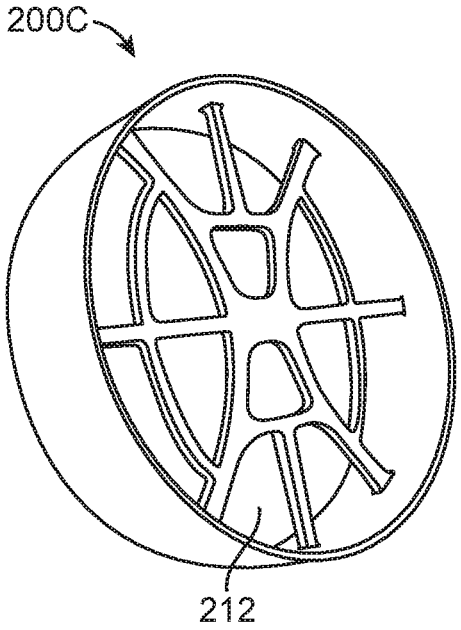
Figure 9C:
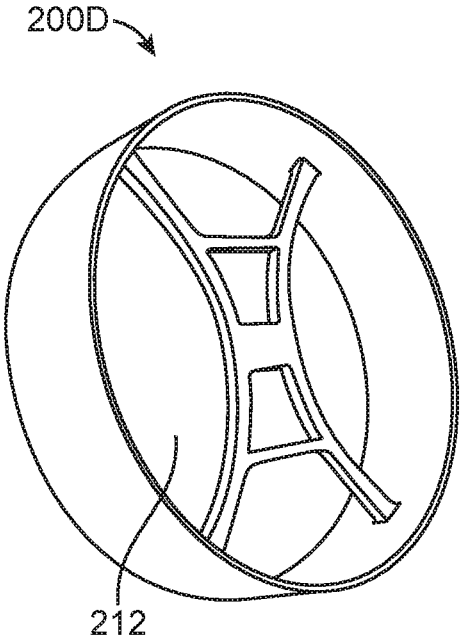
Figure 9D:
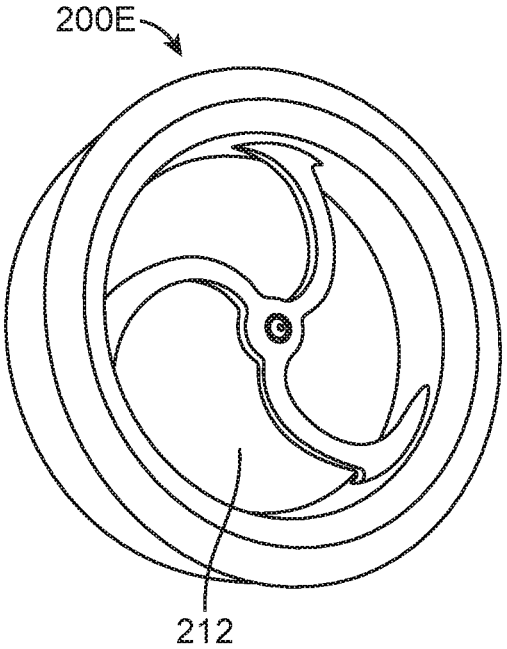

In one embodiment the wheel attachment device is a leg, pair of legs, stand or similar dependent from the body 13. These legs are typically as seen on common golf trolleys or trundlers. Where the legs are hinged at or towards the connection with the body 13. The legs 18 are then able to be hinged out to an operable condition as shown in the FIG. 1. The use of a leg, pair of legs, stand or similar dependent from the body is an example of the wheels being indirectly dependent from the body. A preferred embodiment is shown in FIG. 8C, where the bag carrier has three wheels that extend out on a mechanism comprising the legs. In alternative embodiments, there may be four wheels used for transport (not shown). Preferably the number of wheels used for transport, can also be stored in the wheel compartment.

The golf bag 10 preferably comprises a stopper 17 to prevent the stowed wheels 200 from knocking around within the bag or travelling up the body 13 during transport. The stopper 17 is useful to minimise movement of the stowed wheels 200, to reduce wear and tear of the wheels 200 and the body 13. The stopper 17 is located part way along the golf bag body 13. In one embodiment, as shown in FIG. 1, the stopper 17 is complementary to the shape of the wheels 200.

Figure 4A:
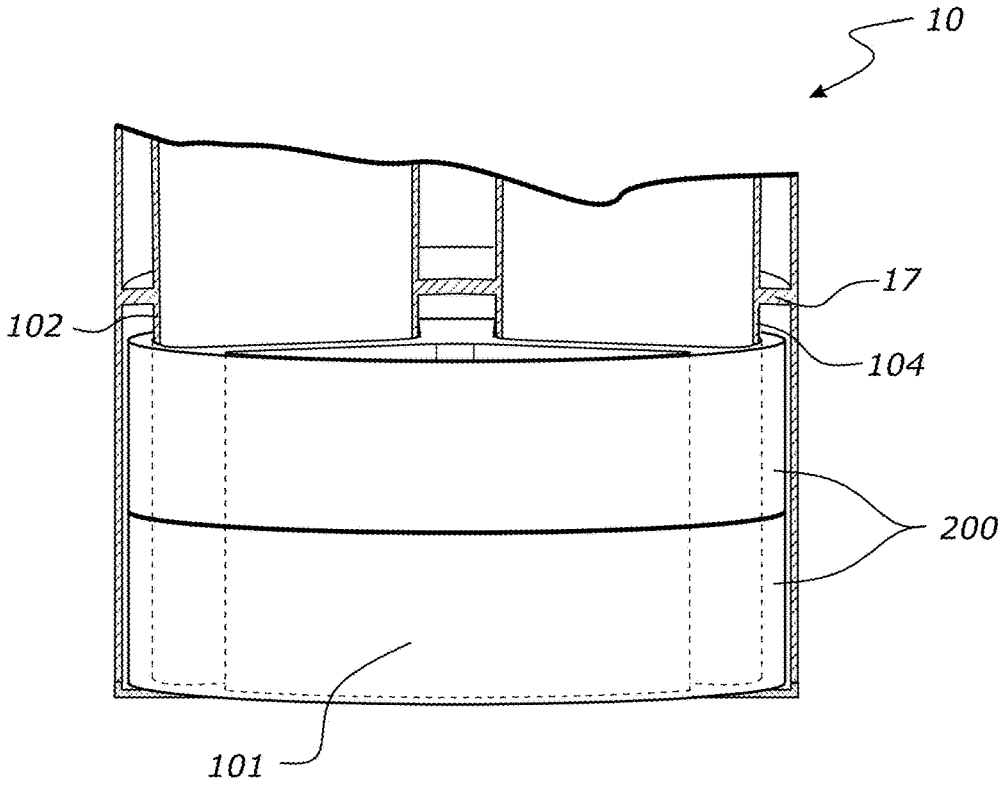
FIG. 4A shows a detailed cross sectional side view of a golf club carrier comprising golf club compartments along the length of the club carrier with two stored wheels.
Figure 4B:
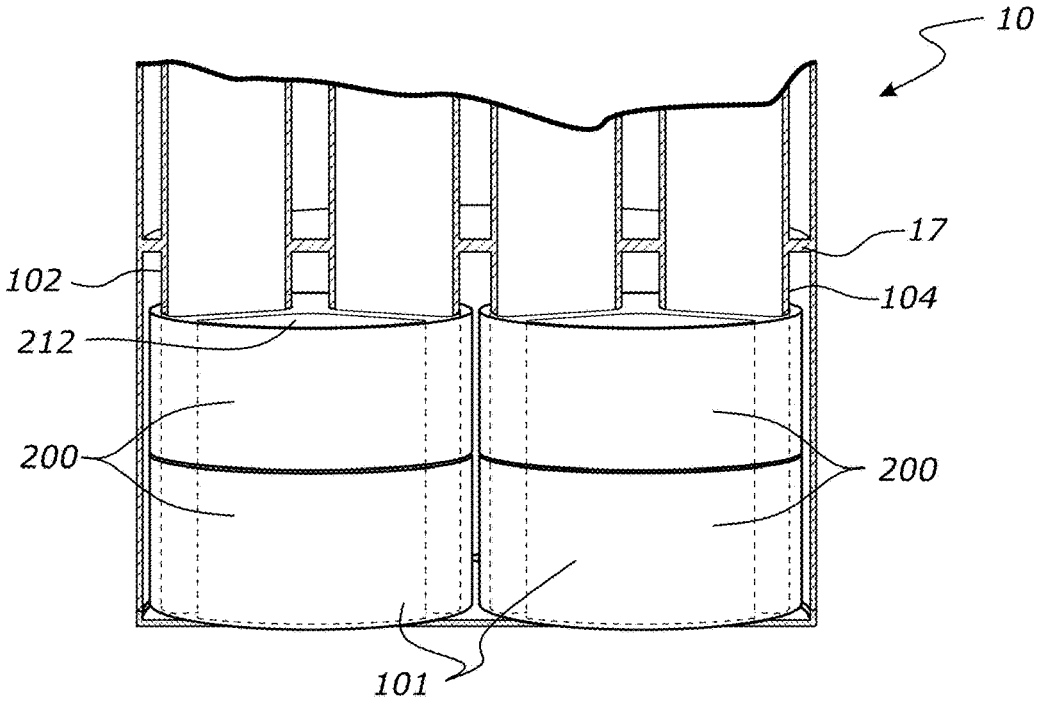
FIG. 4B shows a detailed cross sectional side view of a golf dub carrier of an alternative embodiment with four stored wheels.
Figure 4C:
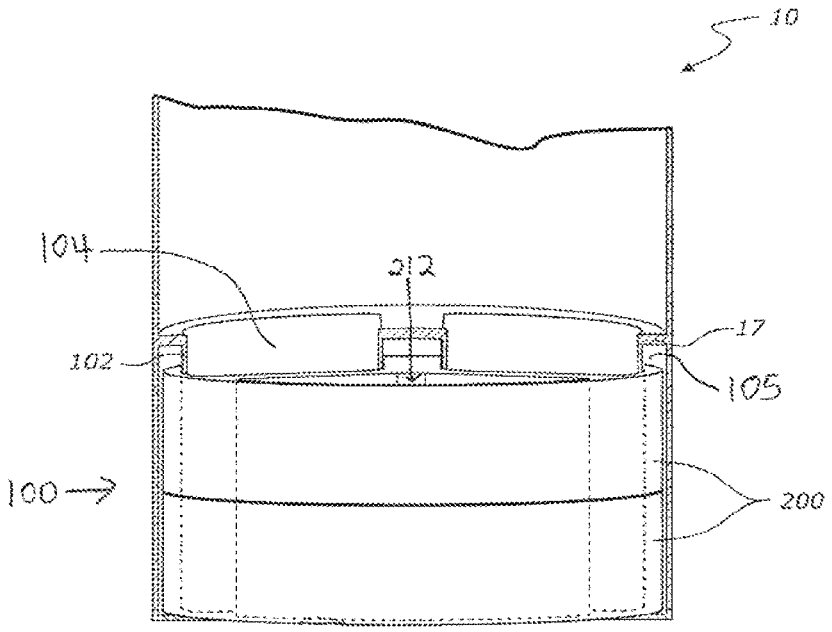
FIG. 4C shows a detailed cross sectional side view of a golf club carrier comprising golf club compartments protruding into the wheel compartment.

In another embodiment, the golf bag 10 comprises a stopper 17 protruding from the inner walls, partially across the golf bag body 13 as shown in FIG. 7A. Preferably, the separator 102 and the stopper 17 are integral as shown in FIG. 4C. FIG. 4C shows pockets 104 that only extend the length of the wheel compartment 100.

Figure 4D:
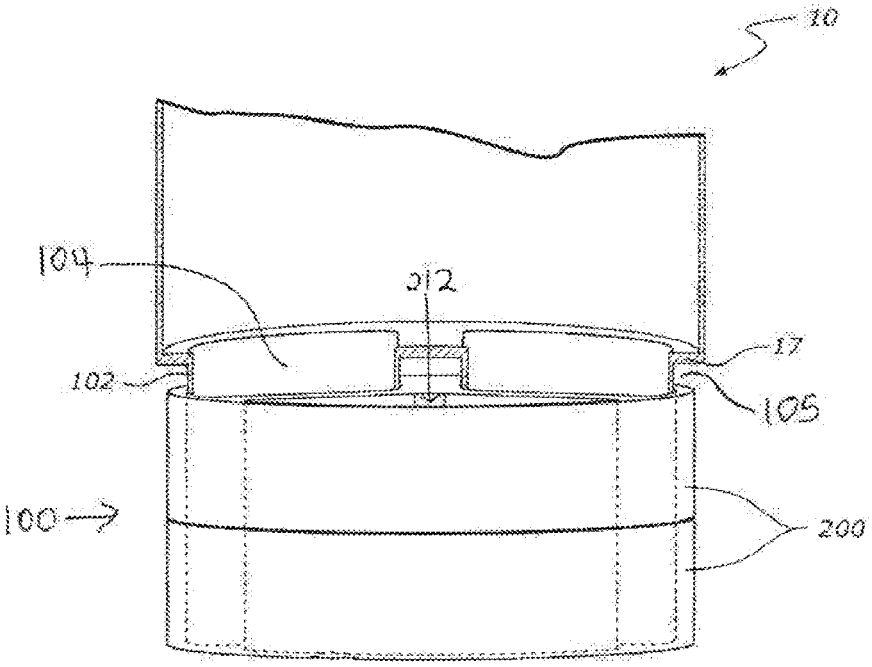
FIG. 4D shows a detailed cross sectional side view of an alternative golf dub carrier having an exposed wheel carrying region.

In an alternative embodiment, the wheel compartment 100 of the golf bag 10 is at least partially open, has openings or is fully open to the environment. A fully open wheel compartment 100 is shown in FIG. 4D. Here the wheel compartment is more a wheel storage region as no compartment is provided about the wheels. This means that the wheels 200 will be at least partially exposed to the environment also. This may be preferable where the wheels 200 get very dirty, and are not desired to be inserted within the bag/wheel compartment. The area where the wheels will now sit is exposed and for clarity may still described herein as a wheel compartment 100, even though the wheels are not inside a compartment.

In one embodiment, the golf bag 10 comprises a spring biasing device (not shown) which supplies a force to the wheels 200 when stored, in the direction towards the base 12 of the bag 10. The spring biasing device pushes the stowed wheels 200 towards the base 12 of the bag 10. Wheels 200 biased towards the base of the bag 12 is advantageous as it will ensure the golf bag 10 has a low centre of gravity, and result in a more stable golf bag in a stationary state or when it is being transported. Additionally wheels 200 biased towards the base 12 of the bag 10 makes accessing the wheels 200 easier from the base 12 of the bag 10. In an alternative embodiment, the wheels 200 are biased towards the base 12 due to gravity.

In one embodiment, the spring biasing device may be a spring biased magazine. The magazine is preferably biased towards the golf bag base 12. In this embodiment a user enters a first wheel 210 into the wheel compartment 100 and the wheel is biased towards the base 12. A user can then still insert a further wheel 220 into the wheel compartment 100, pushing the first wheel 210 upwards, and both wheels being biased towards the base 12. In a further embodiment, a user may insert 2, 3 or more wheels 200 into the wheel compartment 100. For example a user may insert another golfer's wheels into their wheel compartment 100. In an alternative embodiment, a user may insert 2, 3 or more wheels and the wheel compartment 100 does not comprise a spring biased follower.

Figure 6A:
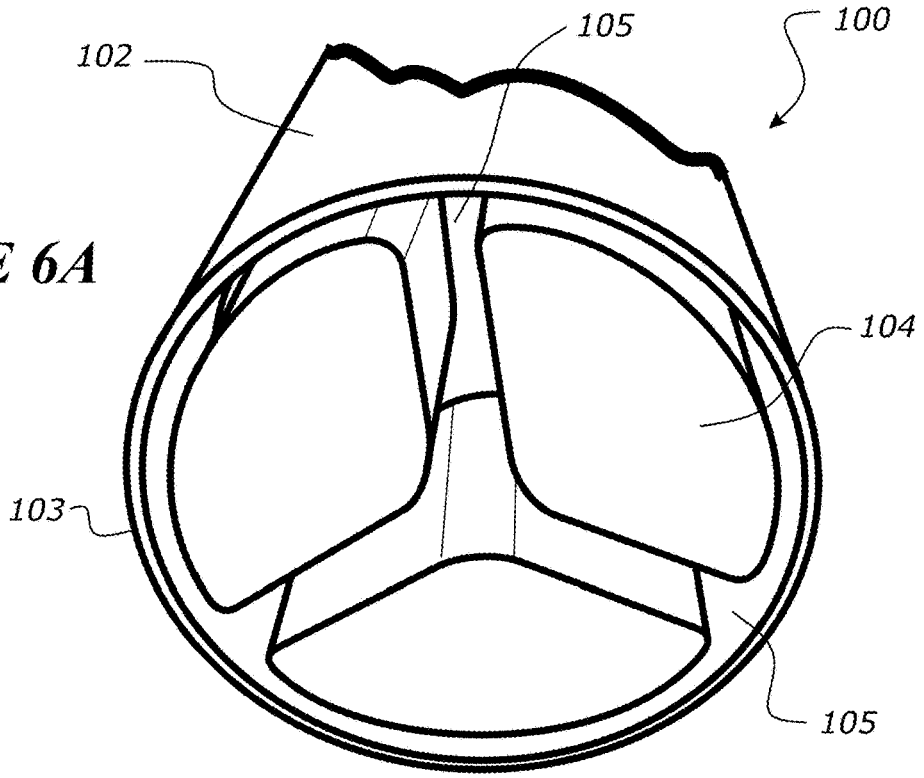
FIG. 6A shows a detailed view of the wheel compartment.
Figure 6B:
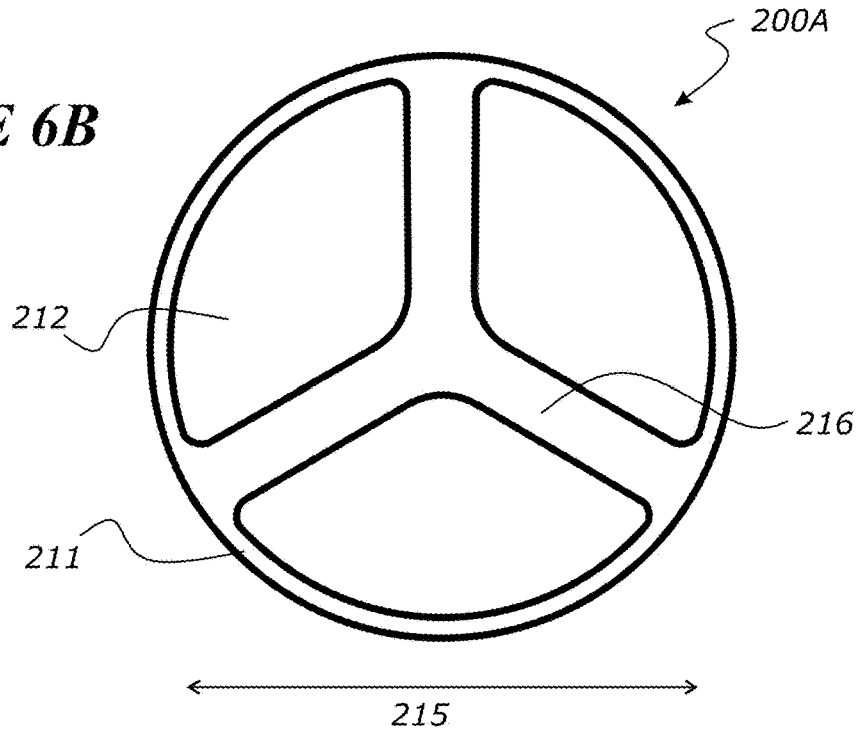
FIG. 6B shows a detailed view of a wheel with a complementary shape to the wheel compartment in FIG. 6A.

FIGS. 5 and 6A shows the wheel compartment 100 further comprises an entry—for a detached wheel 200 to enter into at wheel compartment base 103 and cavities 105—for a detached wheel 200 to be stored in. Preferably, the cavity 105 is complimentary to the profile of the wheels 200. Preferably the profile of the cavity 105 is the same as the profile of wheel 200 as shown in FIGS. 5 and 6A and 6B.

As previously described, the golf bag 10 is compartmented into the golf club storage compartment 101 for receiving and storing golf clubs 1 and a wheel compartment 100 for receiving and storing wheels 200. The golf club storage compartment 101 is configured to extend into the openings 212 of the wheels 200 when the wheels are stored in the wheel compartment 100. In one embodiment, the base of the golf dub storage compartment 101 comprises shell like protrusions 104 or pockets that complement the shape of the openings 212 of the wheels 200, where the shell like protrusions 104 are configured to extend into the openings 212 of the wheels 200, when the wheels are stored in the wheel compartment 100. The protrusions preferably extend to the base 12 of the bag 10, or the lid 14.

The upper side of the protrusions form pockets 104. The pockets 104 open towards the upper region 30 of the golf bag 10, into which at least the end of at least one golf club 1 can enter into. In one embodiment, as shown in FIGS. 1, 2, 3, 4A and 4B, the pockets 104 run the entire length 21 of the body 13 of the golf bag 10 from the lower region 40 to the upper region 30 of the golf bag 10. In another embodiment, as shown in FIG. 4C, the pockets 104 run partially up the body of the golf bag 21 from the lower region 40 towards the upper region 30 of the golf bag 10.

The depth of the pockets 104 preferably correspond to the thickness of the number of wheels 200 to be stored within the golf bag 10. The number of wheels 200 to be stored may be the number of wheels required on the golf bag 10, or It may also include one or more spare wheels. For example, the pockets 104 are the depth of the thickness of one, two, three, or four wheels.

In one embodiment, as shown in FIG. 2, a first wheel 210 enters the wheel compartment 100 from the base 12 of the golf bag 10, followed by the second wheel 220. The wheels 200 are inserted from the base 103 of the wheel compartment 100 in a direction towards to the upper region of the golf bag 10. Each wheel 200 comprises an entry 213 and an exit 214. The projections 104 project through the entry 213 then the exit 214 of the wheels 200.

Figure 2A:
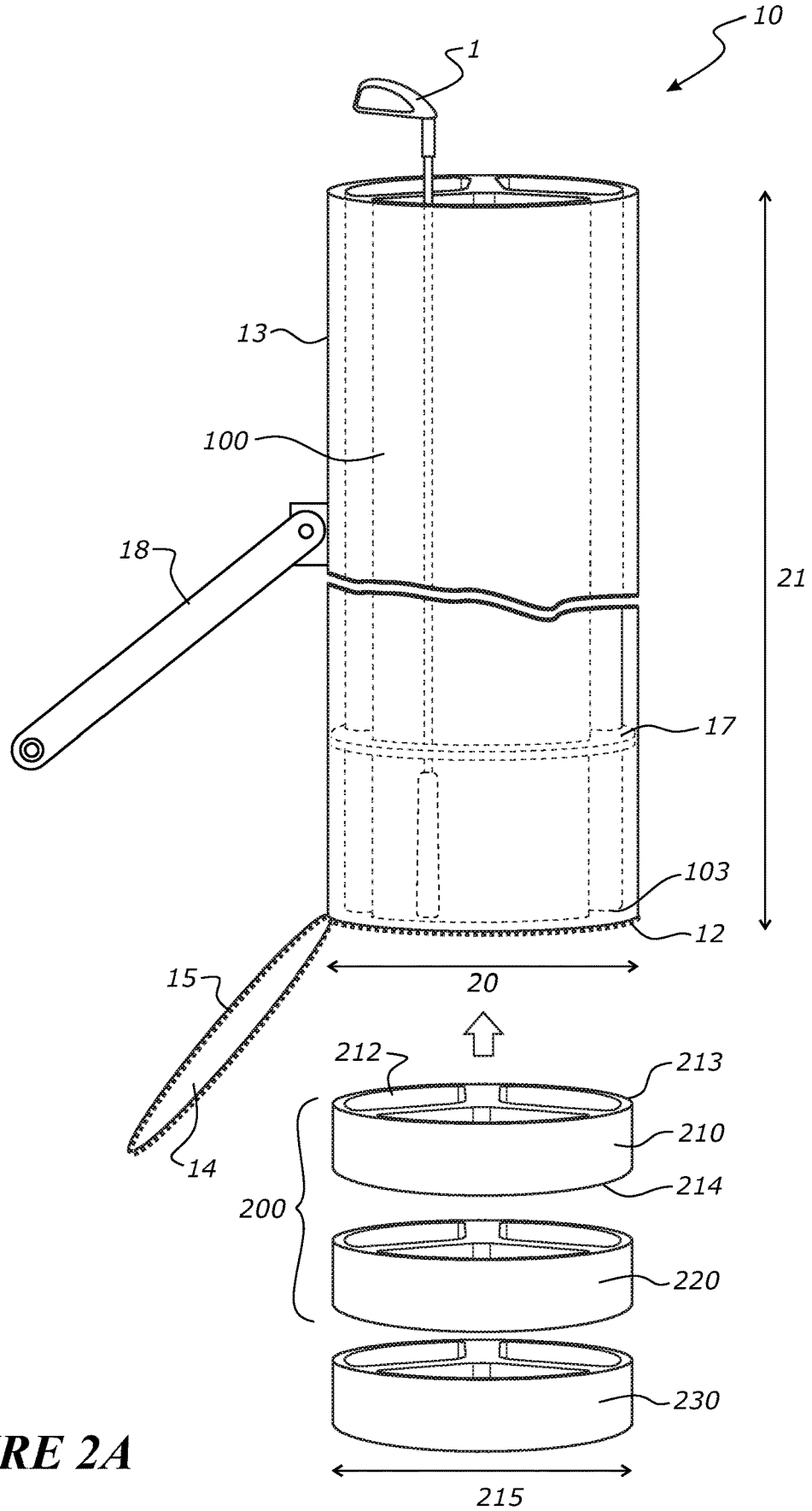
FIG. 2A shows a side view of a golf club carrier with three detached wheels entering the wheel compartment.

In an embodiment, as shown in FIG. 2A, a first wheel 210 enters the wheel compartment 100 from the base 12 of the golf bag 10, followed by the second wheel 220, and followed by a third wheel 230. The wheels 200 are inserted from the base 103 of the wheel compartment 100 in a direction towards to the upper region of the golf bag 10. Each wheel 200 comprises an entry 213 and an exit 214. The projections 104 project through the entry 213 then the exit 214 of the wheels 200.

Preferably, the wheels 200 are symmetrical, to allow for the matching up of wheel openings 212 with the compartments 100 easier. In one embodiment, there are two wheels 200, and the wheels have identical openings 212. In other embodiments, there are three wheels. Again, the wheels have identical openings, or openings that are complimentary to allow a protrusion, pocket, or golf dub pass therethrough.

The wheels have a central hub which forms the rotational axis of the wheel. Spokes or webs extend from the hub to support a rim. The rim may support a tire or may be integrally formed to have a tire like grip or tread. Preferably the wheels are inserted into the wheel compartment and a direction along the rotation axis of the wheel. Preferably the rotation axis of the wheel, is collinear with the rotational axis of the elongate golf club carrier body 10.

The wheels 200 are operable between a transporting condition as shown in FIG. 1, and a stored condition, as shown in FIG. 3 where the wheels 200 are detached from the body 13.

The wheels may be stored in range of different configurations within the wheel compartment 100. As shown in FIGS. 3 and 4A, the wheels 200 may be stacked up the length of the golf bag 21. Additionally, as shown in FIG. 4B, the wheels 200 may be stored side by side.

As shown in FIGS. 2, 6B, the wheels 200 comprises a body 211 and one or more through openings 212. Wherein each wheel 200 has substantially parallel faces, and the openings 212 extend through to each face. The wheel diameter 215 is smaller than the golf bag diameter or width 20. In some embodiments, the wheel 200 has multiple openings 212, and spokes 216 within the wheel 200. The openings 212 are configured to receive an end of at least one golf club 1 whilst in the stored condition. The cross-sectional area of the openings 212 in plan view is greater than the cross-sectional width of at least one golf club 1. In one embodiment, the openings of the wheels 212 are the same profile as the golf club compartments 101.

As shown in FIGS. 1, 2, 5 and 6B, in one embodiment, the wheel 200 has 3 openings to form a 3 spoke wheel 200A, where the spokes extend from a central hub. As shown in FIGS. 9A, 9B, 9C, and 9D, the wheels 200B, 200C, 200D, and 200E may comprise a range of different shaped openings 212. The different shaped openings 212 correspond to varying types and numbers of golf clubs 1 to be stored. Profiles of corresponding golf club compartments 101 preferably correspond to the different shaped openings 212 of the wheels 200.

I claim:

1. A golf club carrier comprising, a body with (i) an upper region with at least one entry to receive a shaft of at least one golf club, club handle first, into a club compartment of the body, and (ii) a bottom region comprising a base opposite the at least one entry, iii) a wheel compartment configured to store at least three wheels, the wheel compartment being located at the bottom region, and (iv) a lid or cover formed in a fabric and further comprises a zip for joining an edge of the lid or cover with an edge of the base at the wheel compartment which when opened provides access at the base to the wheel compartment and which when closed covers the base thereby fully enclosing the wheel compartment at the bottom region, an attachment device attached to the exterior of the body and is adapted to support the body on ground, wherein the at least three wheels are configured to be removably attached to the attachment device, each wheel having a rotational axis and each wheel having one or more through openings, each wheel being moveable between:

a transporting condition where the at least three wheels are attached to the attachment device and are externally dependent from, and configured to rotate and roll over the ground and bear at least some of the weight of the body, and a stored condition where the wheels are detached from the attachment device and stored in the wheel compartment, a separator separating the club compartment from the wheel compartment, the separator being of a shape that complements the shape of at least some of the openings of each wheel to allow the separator to project into the one or more through openings of the wheels when the wheels are stored in the wheel compartment, and to accommodate the at least one golf club in such a manner that the club handle of the golf club can locate in one of the through holes of at least one wheel without coming into contact with the wheel or wheels.

2. The golf club carrier as claimed in claim 1 where each wheel has multiple through openings each located between the rotational axis and the wheel perimeter.

3. The golf club carrier as claimed in claim 1 where the wheels have identical shaped through openings.

4. The golf club carrier as claimed in claim 1, wherein in the stored condition, the at least three wheels are stored coaxially to each other and within the body.

5. A golf club carrier comprising, a body with (i) an upper region with at least one entry to receive a shaft of at least one golf club, club handle first, into a club compartment of the body, and (ii) a bottom region comprising a base opposite the at least one entry, iii) a wheel compartment configured to store at least three wheels, the wheel compartment being located at the bottom region, and (iv) a lid or cover at the wheel compartment which when opened provides access at the base to the wheel compartment and which when closed covers the base thereby fully enclosing the wheel compartment at the bottom region, an attachment device attached to the exterior of the body and is adapted to support the body on ground, wherein the at least three wheels are configured to be removably attached to the attachment device, each wheel having a rotational axis and each wheel having one or more through openings, each wheel being moveable between:

a transporting condition where the at least three wheels are attached to the attachment device and are externally dependent from, and configured to rotate and roll over the ground and bear at least some of the weight of the body, and a stored condition where the wheels are detached from the attachment device and stored in the wheel compartment, a separator separating the club compartment from the wheel compartment, the separator being of a shape that complements the shape of at least some of the openings of each wheel to allow the separator to project into the one or more through openings of the wheels when the wheels are stored in the wheel compartment, and to accommodate the at least one golf club in such a manner that the club handle of the golf club can locate in one of the through holes of at least one wheel without coming into contact with the wheel or wheels.

6. The golf club carrier as claimed in claim 5 where each wheel has multiple through openings each located between the rotational axis and the wheel perimeter.

7. The golf club carrier as claimed in claim 5 where the wheels have identical shaped through openings.

8. The golf club carrier as claimed in claim 5, wherein in the stored condition, the at least three wheels are stored coaxially to each other and within the body.

9. The golf club carrier as claimed in claim 5, wherein the lid or cover at the wheel compartment further comprises a hinge and a snap fit locking mechanism or latch to securely open and close the lid or cover to access the wheel compartment.

* * * * *